US005701053A

United States Patent [19]

Song

[11] Patent Number: 5,701,053

[45] Date of Patent: Dec. 23, 1997

[54] ELECTRON GUN FOR COLOR CATHODE RAY TUBE

[75] Inventor: Yong-seok Song, Suwon, Rep. of Korea

[73] Assignee: Samsung Display Devices Co., Ltd., Kyungki-do, Rep. of Korea

[21] Appl. No.: 560,290

[22] Filed: Nov. 17, 1995

[30] Foreign Application Priority Data

Dec. 31, 1994 [KR] Rep. of Korea ..... 94-40648

[51] Int. Cl.[6] ..... H01J 29/50

[52] U.S. Cl. ..... 313/412; 313/414

[58] Field of Search ..... 313/412, 414, 313/417, 411, 415

[56] References Cited

U.S. PATENT DOCUMENTS

| | | |
|---|---|---|
| 5,025,189 | 6/1991 | Son . |
| 5,032,760 | 7/1991 | Kim . |
| 5,254,903 | 10/1993 | Jo et al. . |
| 5,281,896 | 1/1994 | Bae et al. . |
| 5,386,178 | 1/1995 | Son et al. . |
| 5,399,946 | 3/1995 | Son et al. . |
| 5,523,648 | 6/1996 | Son et al. . |

*Primary Examiner*—Sandra L. O'Shea
*Assistant Examiner*—Mark Haynes
*Attorney, Agent, or Firm*—Leydig, Voit & Mayer, Ltd.

[57] ABSTRACT

An electron gun for a cathode ray tube includes a triode composed of a cathode, a controlling electrode, and a screen electrode. A pre-focusing electrode is provided and supplied with a first voltage for pre-focusing electron beams emitted from the triode. A first auxiliary electrode is provided and supplied with a second voltage which is also supplied to the screen electrode. A second auxiliary electrode is provided and supplied with a third voltage which is also applied to the controlling electrode. The applied voltages create divergent lenses between the focusing electrode and the first auxiliary electrode and between the first and second auxiliary electrode. A main focusing electrode is provided and supplied with the first voltage like the pre-focusing electrode. A converging lens is formed between the second auxiliary electrode and the main lens. A final accelerating electrode is installed adjacent to the main focusing electrode and supplied with a fourth voltage. A main lens is formed between the main focusing electrode and the final accelerating electrode. The electron gun for a cathode ray tube enables uniform electron beam cross-sections throughout the fluorescent film.

11 Claims, 4 Drawing Sheets

ELECTRON GUN FOR COLOR CATHODE RAY TUBE

BACKGROUND OF THE INVENTION

The present invention relates to an in-line electron gun for a color cathode ray tube, and more particularly, to an electron gun for a color cathode ray tube which can compensate for a distortion of electron beams due to the uneven magnetic field of a deflection yoke, by adjusting the angle of incidence of horizontal and vertical electron beams at an auxiliary focusing lens positioned between a pre-focusing lens and a main lens of the electron gun.

Conventionally, the electron beams emitted from the electron gun 2 housed in a neck section 1*a* of a cathode ray tube as shown in FIG. 1 are selectively deflected depending on scanning positions thereof, and landed on a fluorescent film to form a picture. Therefore, in order to obtain a sharp picture, it is crucial to precisely focus the electron beams emitted from the electron gun 2 onto specific points of the fluorescent film.

However, in the conventonal cathode ray tube 1, three electron beams emitted from the in-line electron gun 2 are affected by the uneven deflection magnetic field of the deflection yoke 3 when deflected to the periphery of the fluorescent film by the deflection yoke 3. Thus, when the deflected electron beams are landed on the periphery of the fluorescent film, the electron beam spot is enlarged and distorted, thereby deteriorating the picture quality in the screen periphery. Such a phenomenon is fatal to the improvement of screen resolution.

Several methods have been proposed to solve such problems. For example, a dynamic focusing method uses a quadruplet electrode lens by which the cross-section of the electron beams emitted from the electron gun is distorted in the reverse direction of the uneven magnetic field of the deflection yoke and the focal length of the electron beams is varied according to the landing locations of the electron beams, i.e., whether the electron beams landed on the central portion of the fluorescent film or the outer perimeter thereof. Also, there is used a method of multi-stage focusing and diverging the radiated electron beams by varying the number of electrodes of the electron gun and wiring for applying voltage to the respective electrodes.

FIG. 2 shows a conventional electron gun adopting a unipotential/bipotential wiring to apply voltage to each electrode.

The electron gun shown in FIG. 2 includes a cathode 11, a controlling electrode 12 and a screen electrode 13 making up a pre-triode, a pre-focusing electrode 14, an auxiliary electrode 15, a main focusing electrode 16 and a final accelerating electrode 17 for forming a pre-focusing lens, an auxiliary lens and a main lens. As shown in FIG. 3, screen electrode 13 includes an electrode piece 13*a* where horizontally elongated slots are formed to the portion corresponding to three electron beam passing holes 13H of screen electrode 13, on the electron beam emitting surface of screen electrode 13, thereby forming recesses 13*e*.

A predetermined potential is applied to each electrode; that is, 0V is applied to the control electrode 12, a first static voltage $V_{s1}$ of 300–1200V is applied to screen electrode 13 and auxiliary electrode 15, a second static voltage $V_{s2}$ of 7–9 kV is applied to pre-focusing electrode 14 and main focusing electrode 16, and an anode voltage $V_A$ of 25–32 kV is applied to final accelerating electrode 17.

According to the aforementioned conventional electron gun, when a predetermined potential is applied to each electrode, a pre-focusing lens L1 is formed between screen electrode 13 and pre-focusing electrode 14, and a unipotential electronic lens L2 is formed between pre-focusing electrode 14, auxiliary electrode 15 and main focusing electrode 16, which is a complex lens comprising a divergent lens La formed between pre-focusing electrode 14 and auxiliary electrode 15 and a convergent lens Lb formed between the auxiliary electrode 15 and main focusing electrode 16, as shown in FIG. 4. At the same time, a bipotential main electronic lens L3 is formed between main focusing electrode 16 and final accelerating electrode 17.

Therefore, while passing through pre-focusing lens L1 formed between screen electrode 13 and pre-focusing electrode 14 by horizontally elongated recesses 13*e* formed around electron beam passing holes 13H, of screen electrode 13, the electron beams emitted from cathode 11 diverge horizontally but converge vertically, thereby having a small angle of incidence vertically and a large angle of incidence horizontally. The vertically-converged and horizontally-diverged electron beams pass through unipotential electronic lens L2 and bipotential main electronic lens L3. Since the vertical electron beams have a small angle of incidence with respect to unipotential electronic lens L2, they are incident to bipotential main electronic lens L3 with a small angle of incidence after passing through the center portion of the lens L2 having small spherical aberration. Also, since the horizontal electron beams have a large angle of incidence toward unipotential electronic lens L2, they pass through the periphery of convergent lens Lb after passing the periphery of divergent lens La, thereby acquiring large spherical aberration and having a relatively large angle of incidence toward bipotential main electronic lens L3. Thus, the horizontal electron beams take on a substantially increased spherical aberration. Therefore, the electron beam passing through bipotential main electronic lens L3 produces a horizontally elongated cross-section. The horizontally elongated electron beams are less influenced by the uneven magnetic field of the deflection yoke, thereby reducing haze at the screen's periphery. Here, however, some haze still remains at the screen periphery. Also, such haze becomes more severe for a larger screen.

SUMMARY OF THE INVENTION

To solve the aforementioned problems, it is an object of the present invention to provide an electron gun for a cathode ray tube which can form uniform cross-sections of electron beams landed on the whole fluorescent film and remove haze at the periphery of the fluorescent film, thereby improving the resolution of the cathode ray tube adopting the electron gun.

To accomplish the object of the present invention, there is provided an electron gun for a cathode ray tube comprising:

- a triode composed of a cathode, a controlling electrode and a screen electrode;
- a pre-focusing electrode, first and second auxiliary electrodes and a main focusing electrode which constitute a unipotential electronic lens having a divergent lens and a focusing lens, for pre-focusing and accelerating electron beams emitted from the triode; and
- a final accelerating electrode installed adjacent to the main focusing electrode, for constituting a main lens together with the main focusing electrode, wherein a first static voltage is applied between the controlling electrode and second auxiliary electrode, a second static voltage is applied between the screen electrode and first auxiliary electrode, a focus voltage is applied between the pre-focusing electrode and main focusing electrode, and a higher anode voltage is applied to the final accelerating electrode.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
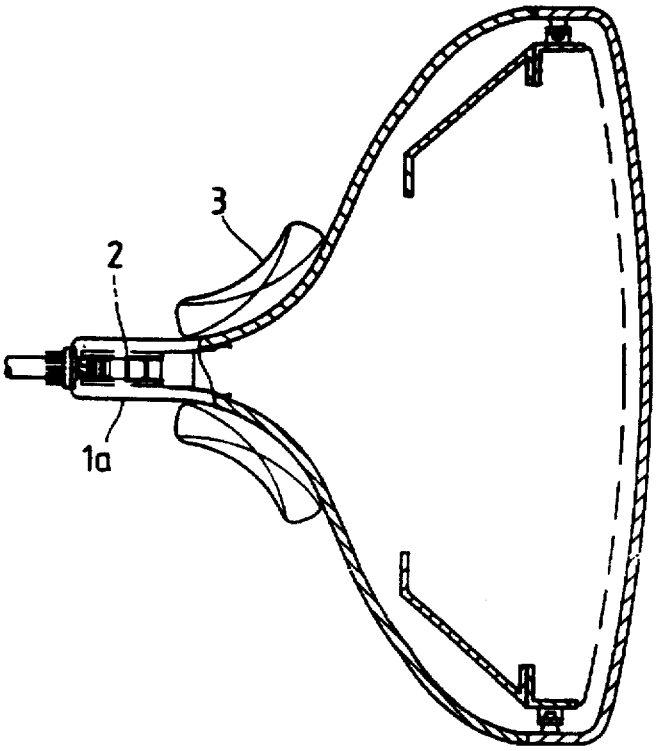
FIG. 1 (PRIOR ART)
FIG. 1 is a cross-sectional view of a general cathode ray tube.
Figure 2:
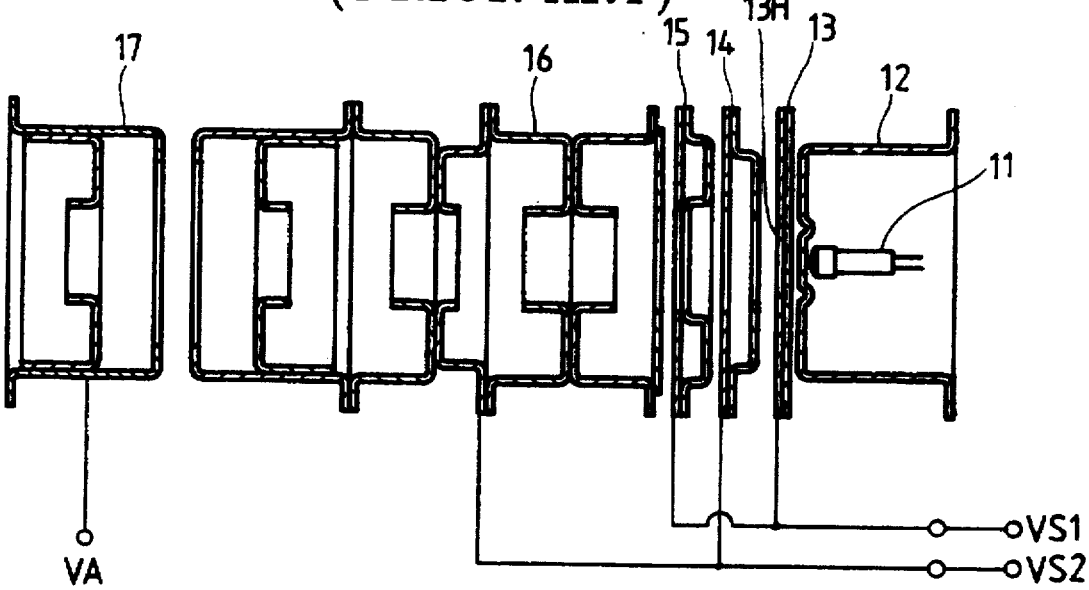
FIG. 2 (PRIOR ART)
FIG. 2 is a vertical sectional view of the electron gun for a conventional cathode ray tube.
Figure 3:
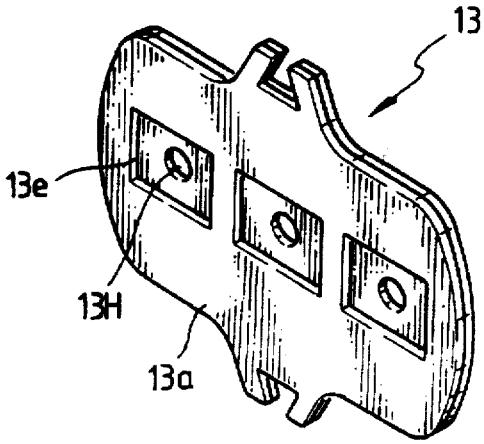
FIG.3 (PRIOR ART)
FIG. 3 is an extracted perspective view of the screen electrode in FIG. 2.
Figure 4:
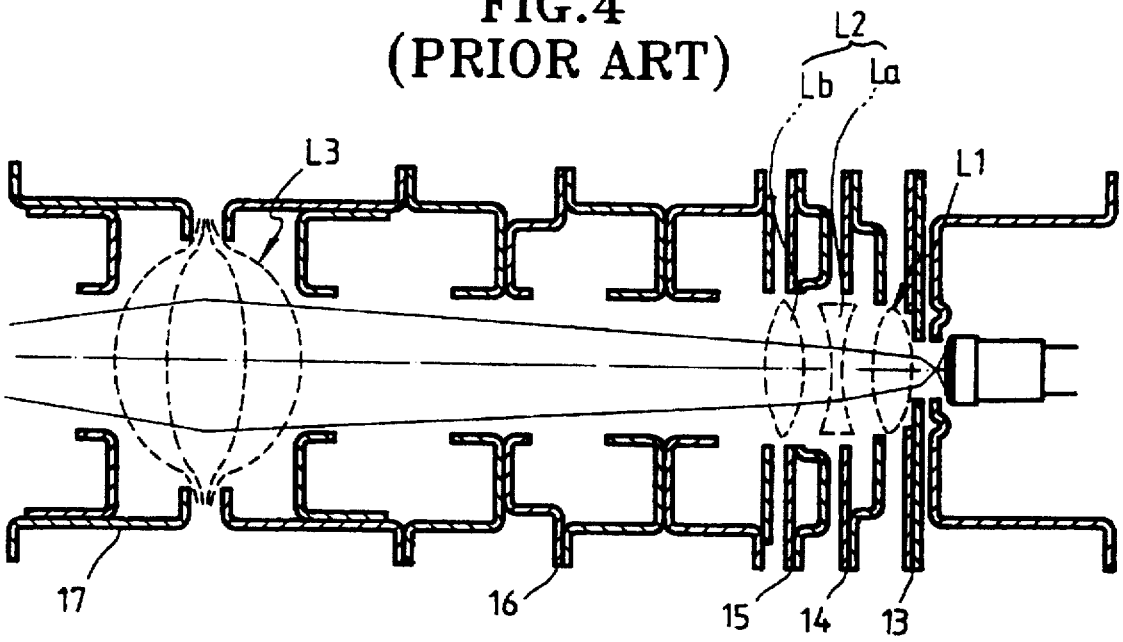
FIG.4 (PRIOR ART)
FIG. 4 is a vertical sectional view of the electron gun for the conventional cathode ray tube, showing the state where electronic lenses are formed between the respective electrodes.
Figure 5:
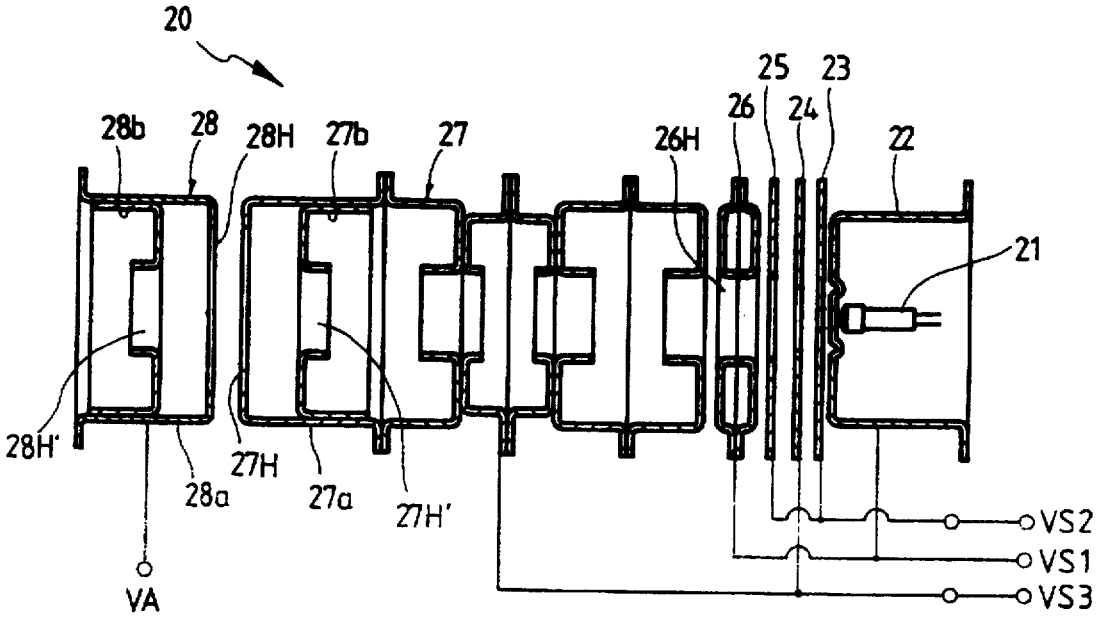
FIG. 5 is a vertical sectional view of the electron gun for cathode ray tube according to the present invention, showing the state where a predetermined voltage is applied to each electrode.
Figure 6:
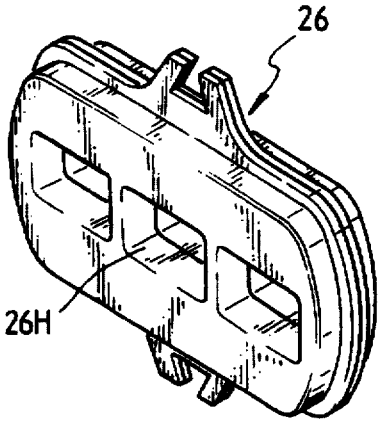
FIG. 6 is an extracted perspective view of the second auxiliary electrode shown in FIG. 5.

As shown in FIG. 5, an electron gun for a color cathode ray tube according to the present invention includes a cathode 21, i.e., an electron beam source, a controlling electrode 22 and a screen electrode 23, which make up a triode, a pre-focusing electrode 24, a first auxiliary electrode 25 and a second auxiliary electrode 26, a main focusing electrode 27, sequentially installed from screen electrode 23, for prefocusing and accelerating the electron beams emitted from triode, and a final accelerating electrode 28 installed adjacent to main focusing electrode 27 and making up a main lens. Here, electron beam passing holes are formed in each electrode. Three electron beam passing holes 26H formed in second auxiliary electrode 26 are horizontally elongated such that their height (vertical dimension) is less than their width (horizontal dimension), as shown in FIG. 6. Electron beam passing holes 26H preferably have a rectangular or oval shape. Main focusing electrode 27 is formed by attaching a plurality of rim electrode members to each other. Also, outer electrode members 27*a* and 28*a* having large-diameter electron beam passing holes 27H and 28H formed therein, and inner electrode members 27*b* and 28*b* having small-diameter passing holes 27H' and 28H' formed therein are installed in the emitting side of main focusing electrode 27 and the receiving side of final accelerating electrode 28, respectively.

A predetermined voltage is applied to each of the electrodes making up the electron gun 20, which will now be described in detail.

A first static voltage $V_{s1}$ of 0V is applied to controlling electrode 22 installed adjacent cathode 21 and second auxiliary electrode 26. A second static voltage $V_{s2}$ of 300–1200V, i.e., higher than the first static voltage $V_{s1}$, is applied to screen electrode 23 and first auxiliary electrode 25. A third static voltage $V_{s3}$ of 7–10 kV, i.e., higher than the second static voltage $V_{s2}$, is applied to pre-focusing electrode 24 and main focusing electrode 27. An anode voltage $V_A$ of 26–36 kV, i.e., considerably higher than the third static voltage $V_{s3}$, is applied to final accelerating electrode 28.

The operation of the electron gun for a color cathode ray tube according to the present invention having the aforementioned configuration will now be described.

Figure 7:
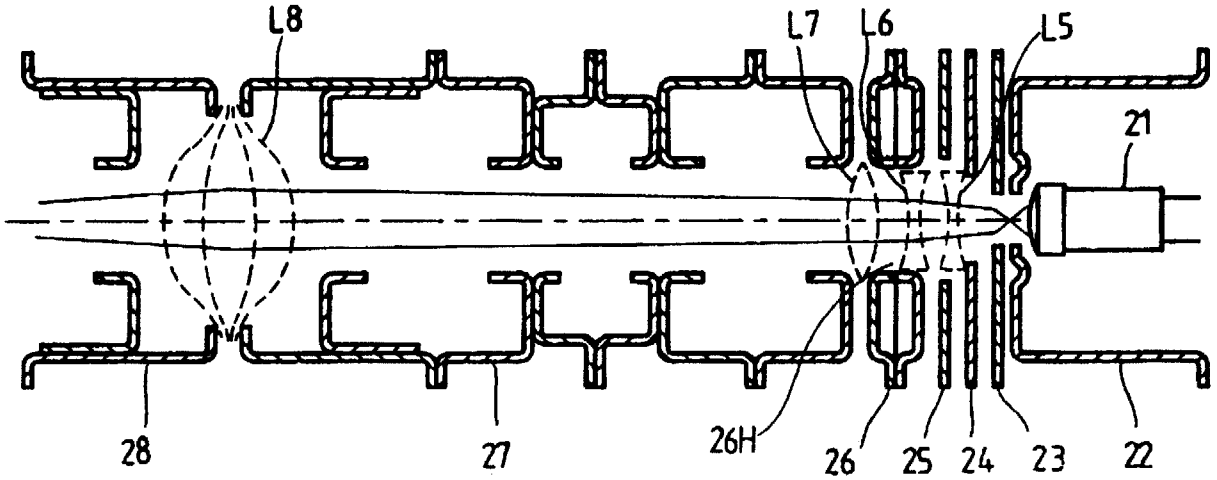
FIG. 7 is a vertical sectional view visualizing the trails of the electron beams formed by the electron gun shown in FIG. 5.
Figure 8:
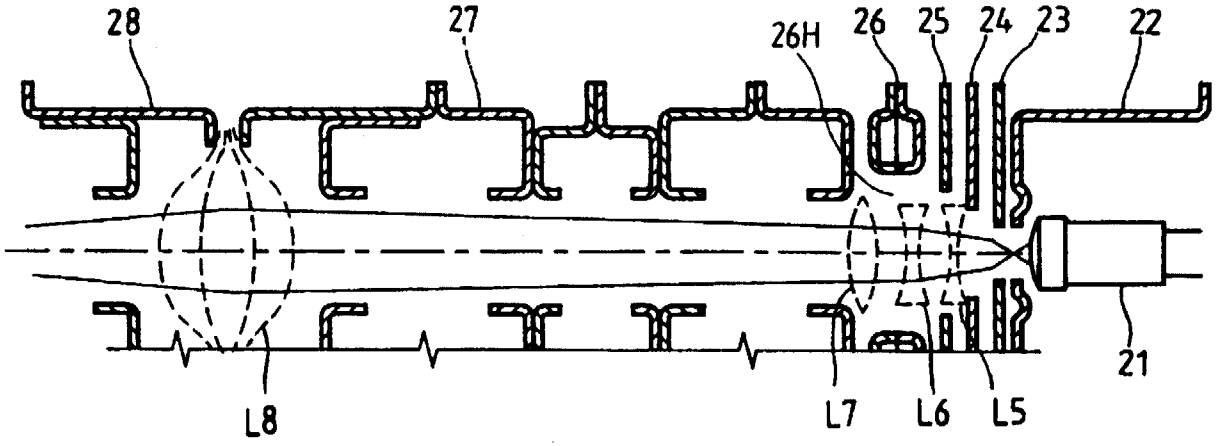
FIG. 8 is a partly cut-away horizontal sectional view visualizing the trails of the electron beams formed by the electron gun shown in FIG. 5.

When the voltages described above are applied to each electrode of the electron gun for the color cathode ray tube according to the present invention, potential differences exist between the respective electrodes, to thus form electronic lenses as shown in FIGS. 7 and 8. Here, a first divergent lens L5 is formed between pre-focusing electrode 24 and first auxiliary electrode 25, and a second divergent lens L6 is formed between first auxiliary electrode 25 and second auxiliary electrode 26. Also, a focusing lens L7 is formed between second auxiliary electrode 26 and main focusing electrode 27, and a main electronic lens L8 having a large diameter is formed between main focusing electrode 27 and final accelerating electrode 28.

Therefore, the electron beams emitted from cathode 21, while passing through the respective electronic lenses, are diverged, focused and accelerated and are then selectively deflected by the lens formed by the deflection magnetic field of the deflection yoke, to be landed on the respective fluorescent points of the fluorescent film. The process by which the electron beams are landed will now be described in view of horizontal electron components and vertical electron components.

First, the vertical component of the electron beams emitted from cathode 21 passing through first divergent lens L5 formed between pre-focusing electrode 24 and first auxiliary electrode 25 are primarily diverged and then secondarily diverged while passing through second divergent lens L6 formed between first and second auxiliary electrodes 25 and 26, as shown in FIG. 7. During the process, due to horizontally elongated electron beam passing holes 26H formed in second auxiliary electrode 26, the vertical component of the electron beams have a relatively strong diverging force compared to the horizontal component thereof. The electron beams diverged in the above manner are focused by focusing lens L7 formed between second auxiliary electrode 26 and main focusing electrode 27. The focusing lens L7 is an asymmetrical lens having a strong focusing power vertically and a weak focusing power horizontally due to the horizontal elongated electron passing holes 26H of second auxiliary electrode 26. Therefore, the vertical electron beams, while passing through focusing lens L7, are focused strongly so that the angle of incidence of the electron beams with respect to main electronic lens L8 becomes small. As the result, the vertical electron beams pass through the center of main electronic lens L8, thereby acquiring relatively small spherical aberration.

As described above, the electron beams passing through the center of main electronic lens L8 pass through the center of the deflection magnetic field, being less influenced due to the uneven magnetic field, thereby preventing the occurrence of a focus deterioration in the screen periphery.

Also, as shown in FIG. 8, the horizontal electron beams emitted from the cathode are diverged by first and second divergent lenses L5 and L6 and then focused by focusing lens L7. Second divergent lens L6 and focusing lens L7 have a weaker horizontal divergent power than vertical divergent power due to the horizontally elongated electron beam passing holes 26H. Thus, the electron beams pass through the periphery region of focusing lens L7 where the horizontal focusing power is weak.

Therefore, the electron beams passing through focusing lens L7 have a large angle of incidence with respect to main electronic lens L8 and pass through the periphery of the main electronic lens LB, thereby acquiring a strong spherical aberration to then be focused more strongly. As a result, the electron beams pass through the center of the deflection magnetic field of the deflection yoke, thereby reducing the diameter of the electron beams landed on the periphery of the fluorescent film and preventing a focus deterioration in the screen periphery.

As described above, the electron gun for a cathode ray tube according to the present invention diverges and converges the electron beams emitted from the cathode to adjust the angle of incidence with respect to the main lens, thereby preventing a deterioration of the electron beams to obtain uniform electron beam cross-sections throughout the entire fluorescent film and improve the resolution of the cathode ray tube.

What is claimed is:

1. An electron gun for a cathode ray tube comprising:

a triode including a cathode, a controlling electrode and a screen electrode;

a pre-focusing electrode, first and second auxiliary electrodes and a main focusing electrode which constitute a unipotential electronic lens having a divergent lens and a focusing lens, for pre-focusing and accelerating electron beams emitted from said triode; and a final accelerating electrode installed adjacent to said main focusing electrode, for constituting a main lens together with said main focusing electrode, wherein a first static voltage is applied to said controlling electrode and the second auxiliary electrode, a second static voltage is applied to said screen electrode and the first auxiliary electrode, a focus voltage is applied to said pre-focusing electrode and the main focusing electrode, and a higher anode voltage is applied to said final accelerating electrode.

2. An electron gun for a cathode ray tube as claimed in claim 1, wherein the second auxiliary electrode includes horizontally elongated electron beam passing holes.

3. An electron gun for a cathode ray tube as claimed in claim 2, wherein said horizontally elongated electron beam passing holes are rectangular.

4. An electron gun for a cathode ray tube as claimed in claim 1, wherein said first static voltage is 0V, said second static voltage is 300–1200V, and said focus voltage is 7–10 kV.

5. An electron gun for a cathode ray tube comprising:

a triode including a cathode, a controlling electrode and a screen electrode;

a pre-focusing electrode, first and second auxiliary electrodes, a main focusing electrode and a final accelerating electrode all disposed in-line;

a first diverging lens disposed between the prefocusing electrode and the first auxiliary electrode;

a second diverging lens disposed between the first and second auxiliary electrodes;

a converging lens disposed between the second auxiliary electrode and the main focusing electrode; and a main lens disposed between the main focus electrode and the final accelerating electrode.

6. An electron gun for a cathode ray tube as claimed in claim 5, wherein the second auxiliary electrode includes horizontally elongated electron beam passing holes.

7. An electron gun for a cathode ray tube as claimed in claim 6, wherein the horizontally elongated electron beam passing holes are rectangular.

8. An electron gun for a cathode ray tube comprising:

a triode including a cathode, a controlling electrode and a screen electrode;

a pre-focusing electrode, first and second auxiliary electrodes, a main focusing electrode and a final accelerating electrode all disposed in-line;

means for applying a first voltage to the controlling electrode and to the second auxiliary electrode;

means for applying a second voltage to the screen electrode and the first auxiliary electrode;

means for applying a third voltage to the pre-focusing electrode and to the main focusing electrode; and means for applying a fourth voltage to the final accelerating electrode.

9. An electron gun for a cathode ray tube as claimed in claim 8, wherein the first voltage is about 0V, the second voltage is between about 300V to about 1200V and the third voltage is between about 7 kV to about 10 kV.

10. An electron gun for a cathode ray tube as claimed in claim 9, wherein the second auxiliary electrode includes horizontally elongated electron beam passing holes.

11. An electron gun for a cathode ray tube as claimed in claim 10, wherein the horizontally elongated electron beam passing holes are rectangular.

* * * * *